US009981718B2

(12) United States Patent
Ricard

(10) Patent No.: US 9,981,718 B2
(45) Date of Patent: May 29, 2018

(54) DEVICE AND METHOD FOR PROTECTING TOWED UNDERWATER OBJECTS FROM FISHING LINES

(71) Applicant: THALES, Courbevoie (FR)

(72) Inventor: Michel Ricard, Sophia Antipolis (FR)

(73) Assignee: THALES, Courbevoie (FR)

( * ) Notice: Subject to any disclaimer, the term of this patent is extended or adjusted under 35 U.S.C. 154(b) by 0 days. days.

(21) Appl. No.: 15/543,214

(22) PCT Filed: Jan. 14, 2016

(86) PCT No.: PCT/EP2016/050626
§ 371 (c)(1),
(2) Date: Jul. 12, 2017

(87) PCT Pub. No.: WO2016/113331
PCT Pub. Date: Jul. 21, 2016

(65) Prior Publication Data

US 2018/0001971 A1 Jan. 4, 2018

(30) Foreign Application Priority Data

Jan. 16, 2015 (FR) ..... 15 00092

(51) Int. Cl.
*B63B 21/66* (2006.01)
*B63G 8/42* (2006.01)

(52) U.S. Cl.
CPC ..... *B63B 21/66* (2013.01); *B63G 8/42* (2013.01)

(58) Field of Classification Search
CPC . B63B 21/66; B63B 21/663; B63B 2021/666; B63G 8/42; B63C 7/00
See application file for complete search history.

(56) References Cited

U.S. PATENT DOCUMENTS 1,358,359 A * 11/1920 Burney ..... B63B 21/66 114/221 A
4,222,340 A * 9/1980 Cole ..... B63B 21/66 114/245
4,718,871 A * 1/1988 Mendelevitch ..... B63H 5/165 114/140
5,042,413 A * 8/1991 Benoit ..... B63B 21/66 114/221 A
5,241,920 A * 9/1993 Richardson ..... B63B 21/66 114/221 R
7,080,607 B2 * 7/2006 Hillesund ..... B63B 21/66 114/244

(Continued)

FOREIGN PATENT DOCUMENTS

FR 2 803 267 A1 7/2001
WO 2014/173979 A1 10/2014

*Primary Examiner* — S. Joseph Morano
*Assistant Examiner* — Jovon Hayes
(74) *Attorney, Agent, or Firm* — Baker & Hostetler LLP

(57) ABSTRACT

A protective device configured to protect a line-cutting device mounted on a cable towed by a surface vessel comprises a blade holder comprising a blade, the blade being formed in the blade holder and being retractable into a slot about a transverse spring pin, wherein the protective device comprises a weighted body of hydrodynamic overall shape delimiting a transverse opening for the passage of the cable and an interior cavity in which the blade is arranged in such a way as to cut any line caught in the cavity, the protective device free to rotate about the cable.

14 Claims, 9 Drawing Sheets

(56) References Cited

U.S. PATENT DOCUMENTS

| | | | | |
|---|---|---|---|---|
| 7,450,467 | B2 * | 11/2008 | Tveide | B63B 21/56 114/245 |
| 7,631,608 | B1 * | 12/2009 | Lombardi | B63C 11/52 114/221 A |
| 9,796,455 | B2 * | 10/2017 | Larsen | G01V 1/3808 |
| 9,851,464 | B2 * | 12/2017 | Hillesund | G01V 1/3826 |
| 2018/0001971 | A1 * | 1/2018 | Ricard | B63G 8/42 |

* cited by examiner

DEVICE AND METHOD FOR PROTECTING TOWED UNDERWATER OBJECTS FROM FISHING LINES

CROSS-REFERENCE TO RELATED APPLICATIONS

This application is a National Stage of International patent application PCT/EP2016/050626, filed on Jan. 14, 2016, which claims priority to foreign French patent application No. FR 1500092, filed on Jan. 16, 2015, the disclosures of which are incorporated by reference in their entirety.

FIELD OF THE INVENTION

The invention relates in general to devices for protecting underwater objects, and in particular to devices for protecting underwater objects towed by a towing surface vessel against fishing lines which may encounter such objects.

BACKGROUND

Underwater objects towed by a towing surface vessel, such as, for example, towed linear acoustic antennas, may encounter partially submerged fishing lines. A towed linear acoustic antenna (also referred to as a "streamer antenna") takes the form of a pipe of a length that is very great (potentially ranging up to several hundred meters long) with respect to its small diameter. Such an antenna is towed by a towing cable measuring several hundred meters and is intended to be submerged to fairly deep depths in the sea. Linear antennas are used for example for anti-submarine warfare or for oil prospecting. In general, a towed body (or towfish) is fixed to the end of the towing cable and is therefore towed at the same time as the antenna.

When detection operations are being carried out in a sea frequented by fishermen using fishing lines, it often happens that these fishing lines strike the towing cable, then slide along the cable before becoming trapped at the anchor point of the towing cable with or without a towed body. The fishing lines are then carried along by the towfish or the cable anchor and strike the antenna, under the effect of vortices. The various elements mounted on the fishing lines (hooks, shackles) may then damage the linear antenna.

Because the linear antenna is generally made from relatively soft elastic materials, the impact of these elements against the antenna often causes significant damage to the antenna and may also have the effect of damaging the towing cable at its anchor point. Furthermore, these lines caught up at this point present a risk of further accident when the cable and the antenna are raised back up to the surface through the fairleads.

A fishing-line-cutting device, mounted at the tail of the cable, has been proposed in patent FR 2 803 267 for cutting fishing lines that become caught in the device before they reach an underwater object towed by the cable. Such a device comprises an elongate blade holder fitted with a blade that can be retracted into a slot formed longitudinally and vertically in this blade holder, while rotating about a transverse thin pin situated at the rear of this blade holder. It also comprises an elongate U-shaped component provided with a straight upper branch and with a lower branch ending in a bill deviating from the axis of this component, these two branches delimiting an interior space in which the blade holder is placed so that it can be fixed to the upper arm.

Such a device can be incorporated only at the anchor point at the tail end of the towing cable for cutting fishing lines which become caught in the device, the cut lines then drifting off into the sea without becoming entangled with the towed object.

However, such a solution is suited only to a very specific towing system incorporating a towed body which is recovered on the outside of the surface vessel using an arm of the launch/recovery system belonging to the surface vessel. It is, on the one hand, attached permanently to the tip of the towed body by means of a special yoke at the interface with the towed body and, on the other hand, connected to the cable tail end hook by a strap. Such a fixing is used for each deployment, when the towed body is being connected to the towing cable.

This device cannot therefore be used for other configurations of towed systems. Furthermore, this device cannot be used directly on a linear antenna being towed on its own. It also has a bulk such that it cannot be used directly on a towed object that is intended to be brought back up to the surface vessel by passing through a specific fairlead, in the manner of a telepheric, before becoming accessible inside the ship. If fishing lines are caught, these may therefore either compromise the recovery of the towed object or lead to further accident (blockage or aggravated damage in the fairlead).

SUMMARY OF THE INVENTION

The invention provides an improvement to the situation. To this end, it proposes a protective device configured to protect a line-cutting device mounted on a cable towed by a surface vessel, the device comprising a blade holder comprising a blade. The blade is formed in the blade holder and is retractable into a slot about a transverse spring pin. Advantageously, the protective device comprises a weighted body of hydrodynamic overall shape delimiting a transverse opening for the passage of the cable and an interior cavity in which the blade is arranged in such a way as to cut any line caught in the cavity, the protective device being free to rotate about the cable.

According to one feature, the protective device may comprise a transverse tube delimiting the transverse opening, the tube being designed to pivot freely about the towing cable.

According to another feature, the interior cavity may delimit an upper part and a lower part, the weighted body being configured to bring the lower part underneath the cable, under the effect of the hydrodynamic and/or hydrostatic forces applied to the protective device.

In one embodiment, the shape of the body may exhibit a hydrodynamic shape configured to keep the interior cavity in position underneath the cable.

To complement that, the shape of the body may exhibit a hydrodynamic shape configured to allow the device to pass over a fairlead.

The hydrodynamic shape may further be configured in such a way that the device lies itself down on a fairlead, substantially flat and on at least one face, when it is wound onto a winding support.

In one embodiment, the protective device may be is covered with elastic material over a chosen thickness of the device.

According to an additional feature, the lower part may comprise a bill-shaped extension inclined downward.

According to another feature, the lower part may have weight and the upper part buoyancy.

The axis of the blade may intersect the median axis of the cavity of the interior cavity toward the bottom whereas the blade passes through the lower part via a slot.

In one embodiment, the protective device may have an ellipsoidal overall shape.

As an alternative, the protective device may have the overall shape of a fin cut to a taper.

The protective device may further comprise an anchor ring for blocking the protective device against translational movement along the towing cable, while leaving it free to pivot about the cable.

The protective device may notably be arranged at the tail of a cable.

The protective device thus allows the line-cutting device to be adapted to any configuration of the towed object or system, including to a linear antenna towed and hauled by itself.

Another advantage of the protective device according to the invention is that it allows the assembly that protects the line-cutting device to be raised back up to the surface in assembled mode through a fairlead or a winch without the need to remove it in order to pass through the fairleads or store it on the drum of the winch.

DESCRIPTION OF THE FIGURES

Other features and advantages of the invention will become apparent from the following description and from the attached figures of the drawings in which.

The drawings and the attachments to the description may not only serve to provide a better understanding of the invention but may also contribute to the definition of the invention, as appropriate.

DETAILED DESCRIPTION

Figure 1:
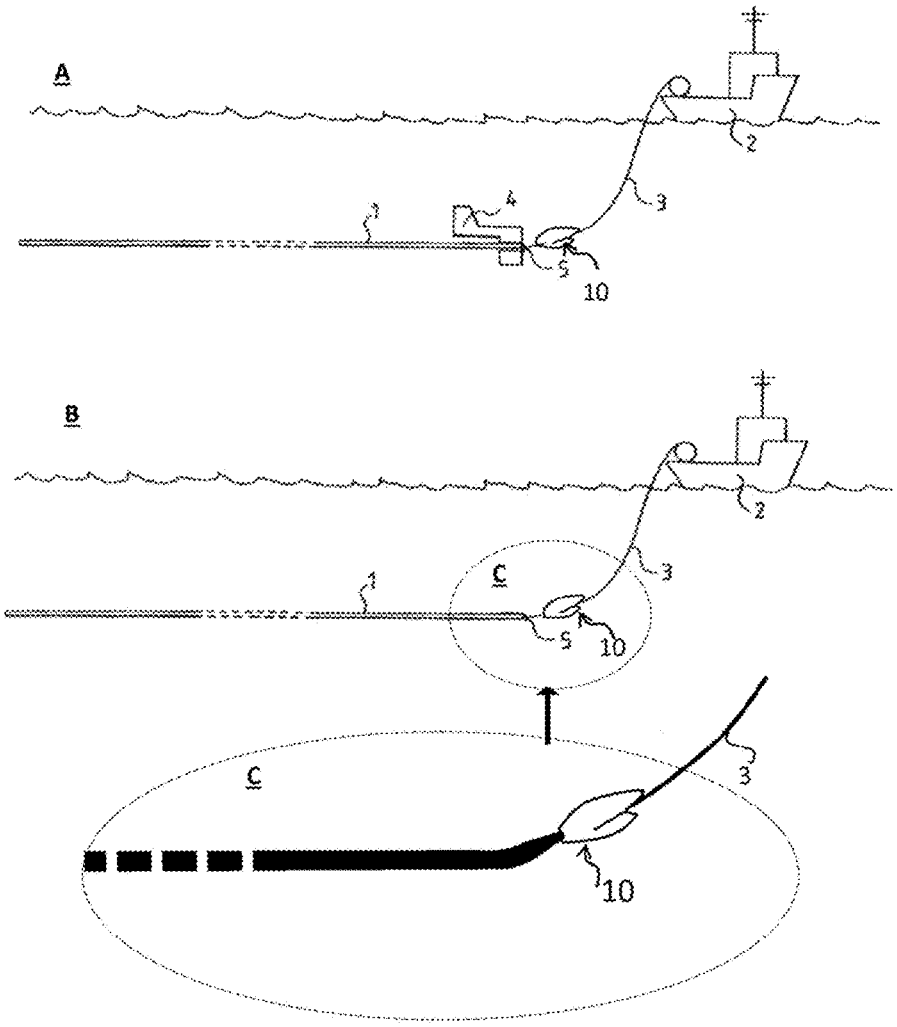
FIG. 1 depicts an example of an environment in which certain embodiments of the invention may be implemented.

FIG. 1 depicts one example of an environment in which certain embodiments of the invention may be implemented.

Naval vessels (surface vessels or submarines) 2 are generally equipped with objects towed by a towing cable 3 (for example of the electric-hauling type) and intended to be immersed in the water, such as, for example, a towed linear antenna 1 incorporating acoustic transducers for emitting and/or receiving acoustic signals in underwater environments, with a towed body 4 as shown in part A of FIG. 1 or without a towed body as shown in part B of FIG. 1. The remainder of the description will be given chiefly with reference to a linear antenna 1 towed by a surface vessel 2 by way of nonlimiting example.

In order to protect the linear antenna 1 against the action of elements carried by fishing lines which may interfere with the towing cable 3, a protective assembly 10 is arranged on the cable to protect the object towed by the towing cable 3 against fishing lines, as shown in the enlarged view C.

Figure 2:
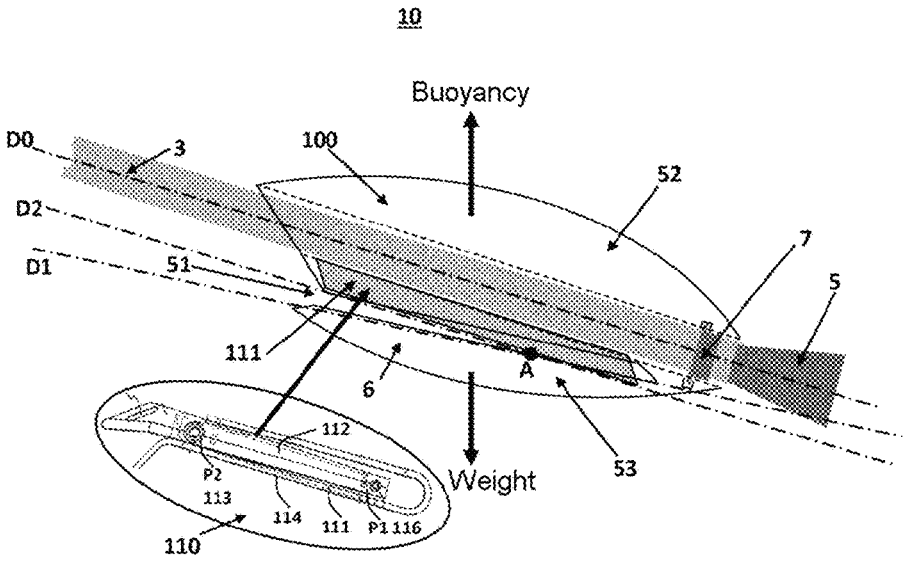
FIG. 2 is a schematic depiction in side view of the protective device mounted on an electric-hauling cable, according to a first embodiment of the invention.

FIG. 2 depicts a protective assembly 10 protecting a towed object 1 against damage caused by fishing lines, according to a first embodiment.

The assembly 10 is preferably fixed to the end 5 of the cable 3 which is connected to the surface vessel 2.

In the embodiment of FIG. 2, the protective device has a body of ellipsoidal (for example ovoid) overall shape.

Such a device can be used on any type of towed object and notably on a simple towed linear antenna.

The protective assembly 10 comprises a protective device 100 for protecting a line-cutting device 110, the line-cutting device comprising a cutting blade 111 which is partially retractable into a slot 114 and is arranged in such a way as to cut lines which become caught in the protective assembly. The lines thus cut free then drift in the sea without the risk of becoming entangled with the towed object 1.

The line-cutting device 110 may be fixed beforehand to a length of cable 3 for example by means of the protective device 100.

One end of the blade 111 may be fixed rigidly at a first point P1 of the line-cutting device 110 whereas the other end is fixed by a spring-loaded pin 113 at a second point P2 of the line-cutting device 110 so that the blade can pivot about the point P2 in the counterclockwise direction when a fishing line caught in the protective device comes to press against the blade. The blade 111 may be chosen to be made of a rustproof material to give better resistance to the marine environment.

In particular, the blade 111 may be fixed vertically in a blade holder provided in the line-cutting device 110 and provided with a longitudinal and vertical slot 114. The blade may be fixed to the front end of the blade holder 112 at the point P1 by a screw 116 and held at the end P2 of the blade holder 112 by a spring-loaded pin 113 so as to pivot about the pin 113 in order to retract from the slot 114. The end of the blade 111 may be cut to a tapered shape.

The line-cutting device 110 may for example be a device of the type described in patent FR 2 803 267, as depicted in FIG. 2. In the example of a line-cutting device described in FR 2 803 267, the line-cutting device 110 may be secured to a fixing yoke the axis of which is perpendicular to the plane of the blade 111, fixed to the upstream part of a towed body and, on the other hand, attached to the cable 3 by a strap at the time of launch.

According to one aspect of the present invention, the protective device 100 takes the form of a profiled and weighted body of hydrodynamic shape, and comprises a first axial opening 50 configured to form a passage for the cable 3 on which the line-cutting device 110 is mounted. As used here, the expression "weighted body" denotes a body with neutral overall buoyancy (buoyancy similar to that of the water).

The protective device delimits an opening 51 (also referred to hereinafter as "throat" or interior cavity) facing toward the upstream end of the towing cable 3 in operational mode and intended to guide fishing lines caught therein toward the blade 111. The throat 51 is arranged over just part of the length of the protective device 100 so that the bottom of the throat is closed. The throat 51 is also configured in such a way that the axis D1, which defines the median axis corresponding to the overall direction of the throat 51, intersects the axis D2 that corresponds to the overall direction of the end of the blade 111 at a point A situated toward the bottom of the throat 51.

The protective device 100 thus delimits, on each side of the throat 51, an upper part 52 through which the cable 3 passes and a lower part 53 forming a jaw.

The jaw 53 may, on the front, have a bill shape oriented downward when the protective device is in a stable position so that even in the air under the action of the forces of gravity, the jaw 53 cannot catch on the thick lip of the fairlead 9.

The height of the throat 51, along the line perpendicular to the axis D1, is preferably small, for example of the order of a few centimeters.

The protective device 100 is configured to be free to rotate about the axis D0 of the length of cable that passes through it while at the same time being able to self-orient itself so as to position the jaw 53 toward the bottom of the water and the upper part 52 toward the surface of the water, in a stable position. In particular, the jaw 53 positions itself on the underneath of the cable 3 in the stable position.

Although not restricted to such applications, the protective device is particularly well suited to towed linear antennas that are said to be "simple" (which is to say which do not have a towed body on which to rely in order to maintain a correct orientation). Specifically, even in the absence of a towed body, the protective device 100 is capable of orienting itself freely under the effect of both the hydrodynamic and hydrostatic forces that are applied to the protective device 100.

In the embodiment of FIG. 2, the protective device 100 has an ovoidal overall shape, with a substantially circular cross section.

The protective device 100 may incorporate a tube 30 made of a material with a low coefficient of friction, in the region of the opening 50, allowing it to pivot freely about the electric-hauling cable 3. The protective device 100 may further comprise an anchored ring 7, provided for example near the termination 5 of the cable 3, to leave the device free to orient itself about the axis D0 while at the same time keeping the protective device at a chosen point on the cable (notably the end 5 of the cable). Blocking the protective device in this position on the cable is of particular benefit when passing through the fairleads during launch.

Figure 3:
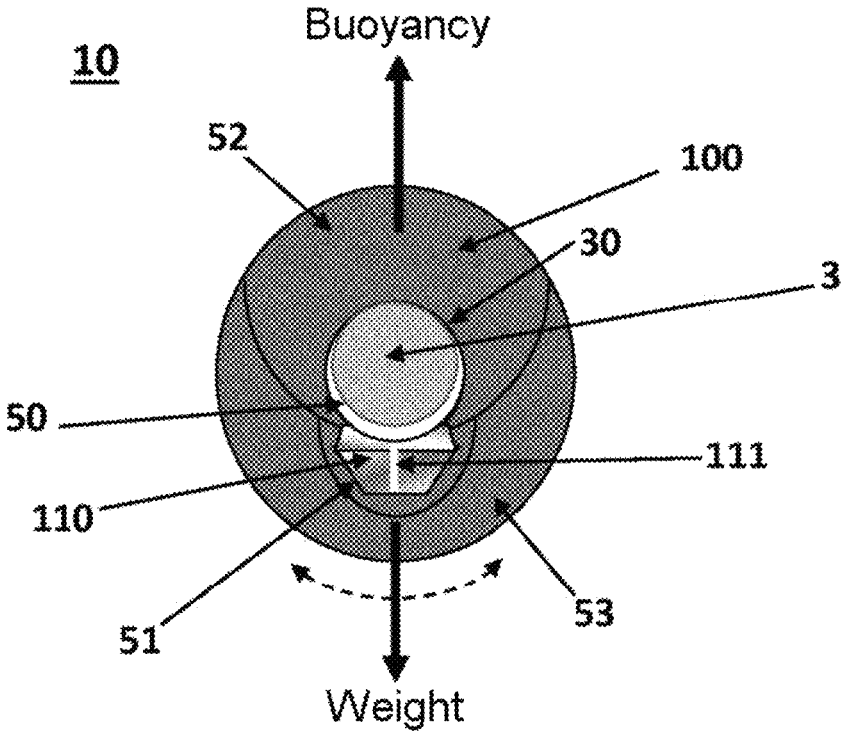
FIG. 3 is a face-on view of the protective device according to the first embodiment of the invention.

The protective device 100 may for example be made up of two assembled parts 52 and 53, as depicted in the example of FIG. 3 which corresponds to the embodiment in which the protective device 100 has an ovoidal overall shape. All of the two parts 52 and 53 have half-shell overall forms exhibiting mating means of mechanical attachment so as to attach to one another, such as, for example, fitting-together and/or screwing-together means.

Advantageously, the protective device 100 may remain in position on the electric-hauling cable 3. It may be removed only for maintenance operations on the line-cutting device 110, such as for replacing the blade 111.

From a hydrostatic standpoint, the self-orientation capability of the protective assembly 10 is provided both by a weight, provided in particular in the lower part 53 (jaw) of the protective device 100 and by the buoyancy of the upper part 52. For example, the lower part may contain a high-density (density higher than that of water) ballast weight and the upper part may comprise a low-density (density lower than that of water) body. The lower part 53 and the upper part 52 thus apply a static righting torque. The assembly allows the stability conferred by its hydrodynamic shapes to be improved further. The jaw 53 is thus ballasted, making it possible to keep the throat 51 and the line-cutting device 110 beneath the cable 3 in the water. The trailing edge of the body 10 and the hydrodynamic forces also stabilize the jaw 53 in this position.

From a hydrodynamic standpoint, the device 10 makes it possible to reinforce a stable position in the stream of water by virtue of the upper part 52 which has a stable center of drag above the electric-hauling cable 3.

Moreover, the jaw shape of the front (prow) of the protective device 100 also allows a fishing line beginning to come into contact with the protective device 100 to be kept correctly oriented under the effect of the drag of the fishing line so that it enters the throat 51 correctly so as to come into contact with the blade and be cut thereby.

Figure 4:
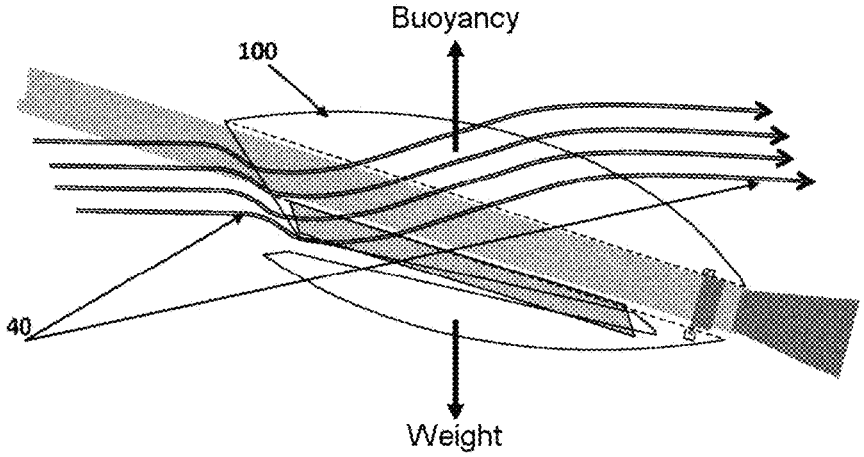
FIG. 4 depicts streamlines of the water and the weight/buoyancy zones seen in side view on the immersed protective device according to the first embodiment.
Figure 5:
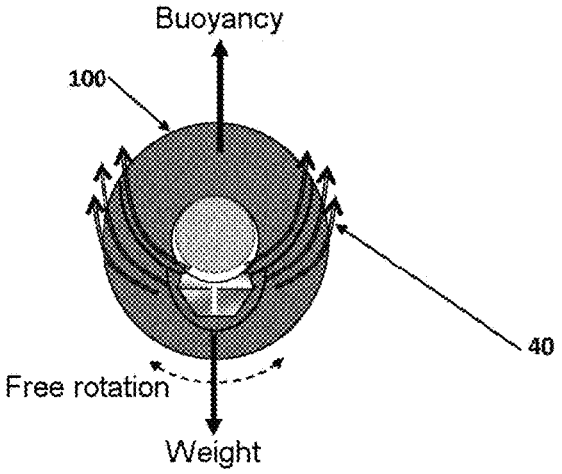
FIG. 5 is a view of the protective assembly showing the streamlines of the water viewed face-on and the weight/buoyancy zones.

FIGS. 4 and 5 schematically depict the streamlines 40 on the two parts 52 and 53 of the protective device 100 when the latter is immersed in the water so as to illustrate the effect of the hydrodynamic forces.

The lower part 53 (jaw) in particular has a volume chosen to be sufficiently small, in comparison with the volume of the upper part 52, that the hydrodynamic drag forces reinforce the orientation of the throat 51 beneath the cable 3 in the stable position, even when the section of cable 3 is near-horizontal.

In the embodiment of FIG. 2, the device is similar to the shape of the head of a whale, with a voluminous upper part and a lower jaw that is long/slender and of lesser thickness.

The protective device 100 may notably be covered with an elastic material over a certain thickness (such as with PU for example), so as to be better integrated when stored on the drum of the handling winch, between cable and antenna.

Figure 6:
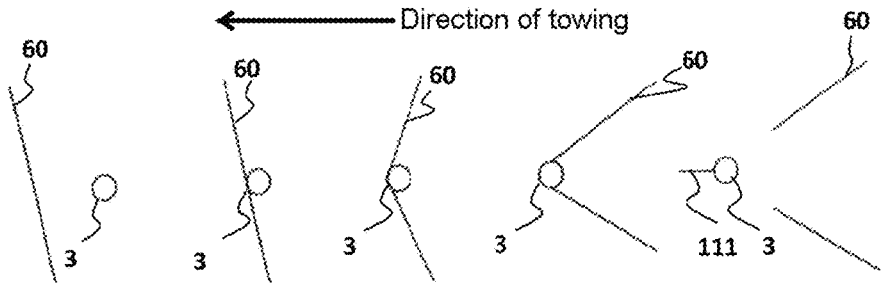
FIG. 6 is a schematic view depicting the various states of a fishing line becoming caught in the protective device.

FIG. 6 shows the progression of a fishing line 60 that becomes caught in the protective assembly 100.

When the object 1 is towed by the surface vessel in a sea frequented by fishermen using fishing lines, it often happens that these fishing lines strike the electric-hauling cable 3.

The lines slide along the cable 3 toward the termination 5 and are then conveyed toward the throat 51 situated at the level of the termination 5 of the cable 3. The throat 51, because of the path it describes, then directs the lines toward the line-cutting device 110 which cuts through the lines with the blade 111 when the lines come into contact therewith. The cut lines are then freed and drift in the sea without having damaged the towed system or object (for example a linear acoustic antenna 1).

The protective assembly 10 may be assembled onto the towing cable 3 before the object is immersed in the water for the first time, and can thereafter remain thereon. In one embodiment in which the towed object is a linear antenna 1, the linear antenna 1 may be initially wound onto a drum and paid out for launching the antenna into the water through a fairlead 9.

Because the protective device 100 is free to rotate about the cable 3, in embodiments in which the jaw 51 is narrow, the protective device may have a tendency to lie down on its side as it passes through the fairlead 9 or for being wound onto the drum.

Because the upper body 52 is more voluminous than the jaw 53 so that the fairlead encounters first of all this upper body 52 rather than the jaw 53, in the air, for passage through the fairlead 9.

Figure 7:
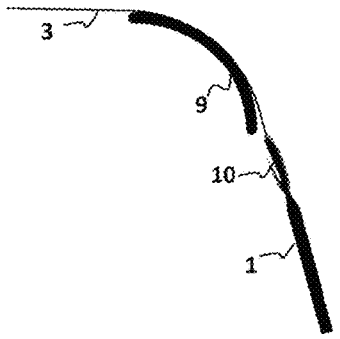
FIG. 7 is a diagram illustrating the respective placement of the cable, of the protective device and of the antenna as these elements are being brought back up through a fairlead onto the surface vessel in assembled form, according to the first embodiment of the invention.

FIG. 7 is a diagram illustrating the respective placement of the cable 3, of the protective assembly 10 including the line-cutting device 110 and of a towed object 1 of antenna type on a fairlead 9 as these elements are being brought up onboard the surface vessel in assembled form.

The protective assembly 10 may be assembled with the cable 3 before the antenna 1 is launched and may thereafter remain thereon. The shape of the protective device 100, with no major roughnesses, is suited to passage through the fairlead of a winch.

Likewise, when the antenna 1 has to be brought back up onboard the surface vessel 2, the linear antenna 1 may be wound onto a drum by a winch system, again passing through the fairlead 9 in the opposite direction to the direction of launching, without there being a need to remove the protective assembly 10 beforehand. The device 10 allows the assembly to be rid of the fishing lines as it is being towed and therefore also before the towed object 1 is recovered and passes through the fairlead.

The anchor ring 7 allows the device 10 to be kept at the foot of the cable on passing through the fairlead 9 at the time of launch.

The protective assembly 10 may thus remain in place on the electric-hauling cable 3 and is compatible with the operations of passage through a fairlead 9 and/or winding onto/paying out from a drum. Specifically, its length may be relatively short, its shape is suited to such winding, and it may be made of materials that are not aggressive toward the antenna (elastomeric materials) which are wound over the cable 3 and under the antenna 1.

As a result, there is no longer a need to fit/remove or connect/disconnect the protective device for each launch or recovery of the towed assembly (protective assembly mounted on the towed object assembled with the electric-hauling cable).

Figure 8:
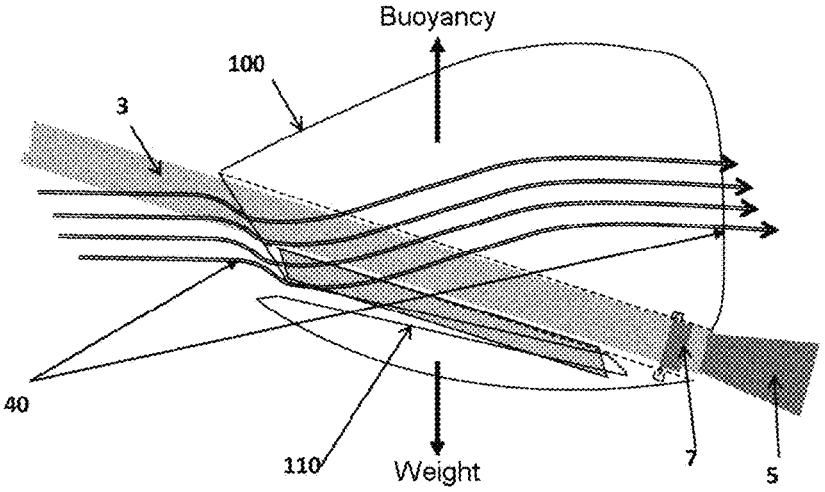
FIG. 8 is a schematic depiction of the protective device mounted on an electric-hauling cable, seen in side view according to a second embodiment of the invention, with the streamlines of the water and the weight/buoyancy zones.

FIG. 8 is a schematic depiction in side view of the protective device mounted on an electric-hauling cable 3, according to a second embodiment of the invention.

In this embodiment, the protective device 100 has the overall shape of a flexible fin or fairing free to rotate likewise about the cable 3 and comprises a leading edge which incorporates the jaw 53 and the throat 51 in which the line-cutting device 110 is housed.

In order not to damage the cable 3 on which the protective device 100 may lie down or the linear antenna under which it might be stored, the material of the protective device may be chosen to be relatively flexible/elastic (for example a rubber or synthetic such as PU/PE/PVC/etc.).

Figure 9:
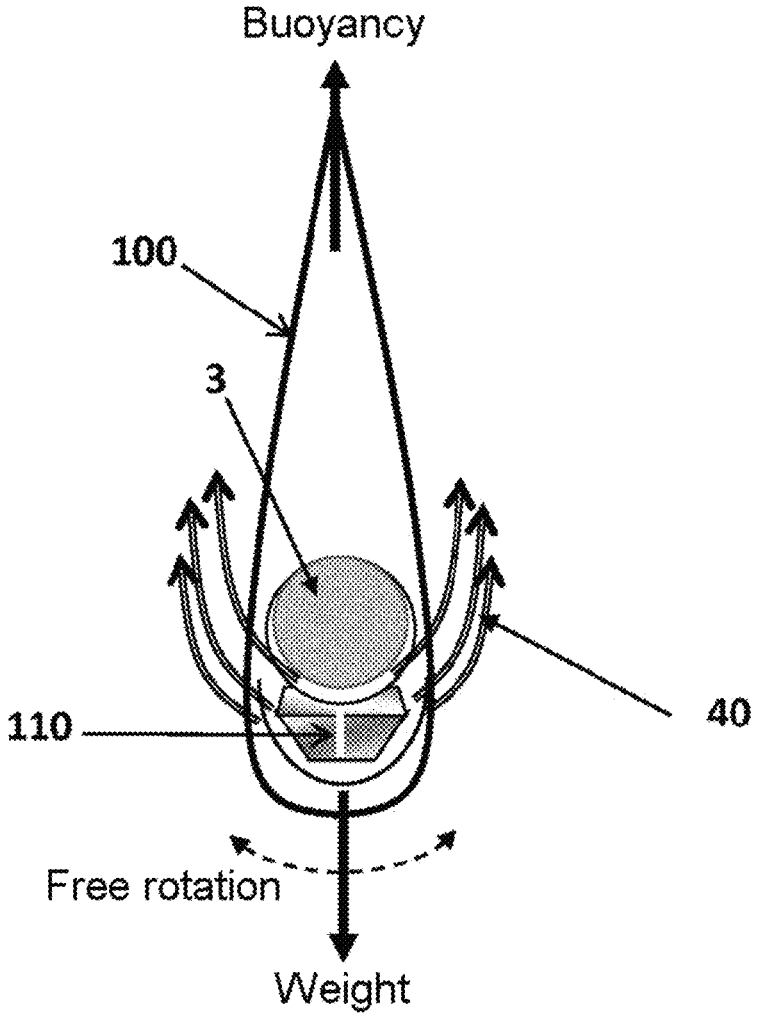
FIG. 9 is a face-on view according to a second embodiment of the invention, with the streamlines of the water and the weight/buoyancy zones.

FIG. 9 is a face-on view of the protective assembly showing the weight/buoyancy zones and the hydrodynamic streamlines according to the second embodiment. This fin shape may help with better hydrodynamic control during towing and ease of passage through the fairlead. By contrast, it must be made from a soft/elastic material so as not to impede the winding onto the winch.

Figure 10:
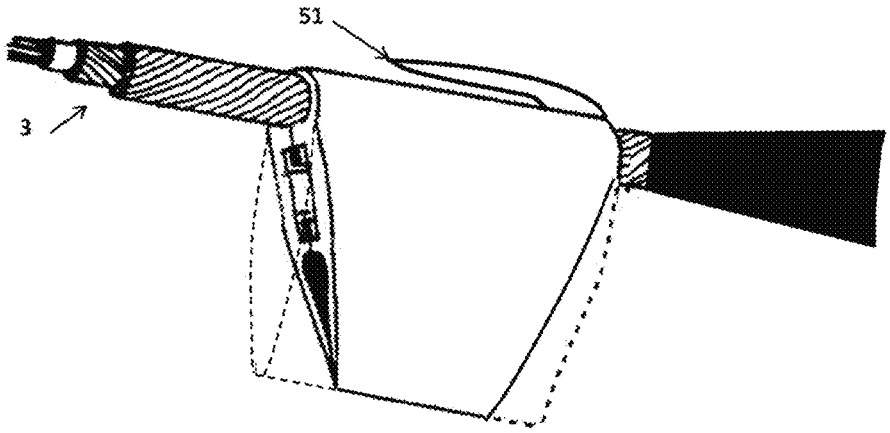
FIG. 10 is a perspective view depicting one example of the shape of the protective assembly according to the second embodiment.

FIG. 10 shows the overall shape of the protective device 100 according to the second embodiment.

The protective device 10 is in the shape of a fin with a trailing edge cut to a taper and configured to make the device 100 lie down in order to pass through the fairlead 9.

Figure 11:
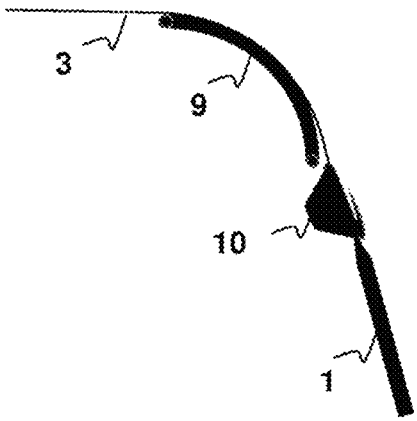
FIG. 11 illustrates the respective placement of the cable, of the protective device and of the antenna when these elements are being brought up through a fairlead onto the surface vessel in assembled form according to the embodiments of FIGS. 8 to 10.

FIG. 11 shows the passage through the fairlead 9 thanks to the ability of the protective device 100 to self-position itself. Such a protective device may be configured to be stored flat on the drum.

The invention thus offers an effective solution for protecting against fishing lines whatever the system towed, such as, for example, a towed linear antenna without a towed body.

The invention dispenses with the need to use a pole fitted with shears in order to get rid of the fishing lines outside the vessel, before the fairlead, from the rear area which remains an exposed place.

It also offers a generic solution that can be adapted directly to suit any towed system.

The invention is not restricted to the embodiments described hereinabove by way of nonlimiting example. It encompasses all alternative forms of embodiment that are conceivable to a person skilled in the art. In particular, the invention is not restricted to the type of line-cutting device depicted in FIG. 2 or to the forms of the device 100 which are illustrated in FIGS. 2 and 8. For example, the protective device 100 may have an ellipsoidal shape similar to that of FIG. 2, but provided with a flexible top made of soft material that is reinforced so that it does not tear as it passes through the fairleads.

The invention claimed is:

1. A protective device configured to protect a line-cutting device mounted on a cable towed by a surface vessel, said device comprising a blade holder comprising a blade, said blade being formed in said blade holder and being retractable into a slot about a transverse spring pin, wherein the protective device comprises a weighted body of hydrodynamic overall shape delimiting a transverse opening for the passage of the cable and an interior cavity in which said blade is arranged in such a way as to cut any line caught in the cavity, the protective device being free to rotate about the cable.

2. The protective device as claimed in claim 1, comprising a transverse tube delimiting the transverse opening, said tube being designed to pivot freely about the towing cable.

3. The protective device as claimed in claim 1, wherein the interior cavity delimits an upper part and a lower part, the weighted body being configured to bring the lower part underneath the cable, under the effect of the hydrodynamic and/or hydrostatic forces applied to the protective device.

4. The protective device as claimed in claim 1, wherein the shape of said body exhibits a hydrodynamic shape configured to keep the interior cavity in position underneath the cable.

5. The protective device as claimed in claim 4, wherein the shape of said body exhibits a hydrodynamic shape configured to allow the device to pass over a fairlead.

6. The protective device as claimed in claim 5, wherein said hydrodynamic shape is configured in such a way that the device lies itself down on a fairlead, substantially flat and on at least one face, when it is wound onto a winding support.

7. The protective device as claimed in claim 1, wherein it is covered with elastic material over a chosen thickness of the device.

8. The protective device as claimed in claim 3, wherein the lower part comprises a bill-shaped extension inclined downward.

9. The protective device as claimed in claim 3, wherein the lower part has weight and the upper part buoyancy.

10. The protective device as claimed in claim 3, wherein the axis of the blade intersects the median axis of the cavity of the interior cavity toward the bottom and in that the blade passes through the lower part via a slot.

11. The protective device as claimed in claim 1, wherein the protective device has an ellipsoidal overall shape.

12. The protective device as claimed in claim 1, wherein the protective device has the overall shape of a fin cut to a taper.

13. The protective device as claimed in claim 1, further comprising an anchor ring for blocking the protective device against translational movement along the towing cable, while leaving it free to pivot about the cable.

14. The protective device as claimed in claim 1, wherein it is arranged at the tail of the cable.

* * * * *